US005229531A

United States Patent [19]

Song

[11] Patent Number: 5,229,531

[45] Date of Patent: Jul. 20, 1993

[54] TOY CAP GUN WITH LIGHT TRANSMITTING, GLOW IN THE DARK CHAMBER

[75] Inventor: Myung Song, Gladwyne, Pa.

[73] Assignee: Larami Corporation, Philadelphia, Pa.

[21] Appl. No.: 924,286

[22] Filed: Aug. 3, 1992

[51] Int. Cl.[5] ..... F41C 3/10

[52] U.S. Cl. ..... 42/58; 446/473

[58] Field of Search ..... 42/58, 54, 55, 57; 446/23, 219, 473

[56] References Cited

U.S. PATENT DOCUMENTS

| | | | |
|---|---|---|---|
| 1,436,715 | 11/1922 | Jackson | 42/58 |
| 2,734,311 | 2/1956 | Christopher | 446/473 |
| 4,569,666 | 2/1986 | Wolf | 446/473 |
| 4,598,491 | 7/1986 | Noble | 42/58 |

*Primary Examiner*—David H. Brown
*Attorney, Agent, or Firm*—Kenneth P. Glynn

[57] ABSTRACT

The present invention is a toy cap gun, which includes a gun housing having a forward end and a rearward end, a chamber, a barrel, a cap anvil, a hammer and a trigger. The chamber is formed of material which permits light from a cap firing flash to be visible therethrough, and the chamber further contains an effective amount of a glow in the dark material. Further, the chamber is movably located within the housing and the chamber and housing together are adapted to load and unload caps. The barrel is located at a forward end of the housing and the chamber. There is a rotatable cap anvil which is located on a rearward end of the chamber, extending into the chamber and adapted to hold caps. The hammer is located on the housing, is connected to a trigger mechanism and is located adjacent to the cap anvil for intermittently striking and detonating caps. There is a trigger mechanism extending from the housing and functionally connected to the hammer for intermittently impacting the hammer to detonate caps.

14 Claims, 1 Drawing Sheet

TOY CAP GUN WITH LIGHT TRANSMITTING, GLOW IN THE DARK CHAMBER

BACKGROUND OF THE INVENTION

1. Field of the Invention

The present invention is directed to a toy cap gun, such as a pistol or rifle or other type of cap gun which contains cap firing capabilities. More specifically, it is directed to a toy cap gun having an at least partially transparent (translucent or transparent) chamber which has glow in the dark material of construction.

2. Prior Art Statement

Cap guns have been popular with youngsters for many years. Typically, caps are fed to an anvil and hammer and a trigger on the cap gun is pulled to cause the cocking and release of the trigger to strike the cap against the anvil to cause detonation. Upon detonation, a spark or flash occurs along with a loud sound. The trend has been toward caps with louder and louder noise as well as brighter flash.

U.S. Pat. No. 4,598,491 describes a toy cap gun in which a chamber is used to produce a dramatic sound and light effect when the caps are detonated by creating proper acoustics and by providing for a transparent or translucent chamber. The present invention is directed to toy cap guns which are an improvement over and unobvious over the U.S. Pat. No. 4,598,491 toy cap guns because the present invention cap guns include glow in the dark material incorporated into the barrel. This creates a dramatic night-time effect by having the glow in the dark chamber attract the gun to the eye of the observer before the detonation of the cap occurs. Additionally, it enables children to easily locate the toy cap guns in the dark, whether outside or inside the home or in a closet or otherwise. Additionally, there is a synergistic effect between the glow in the dark chamber and the simultaneous "lightening" effect of the flash in the dark. The glow in the dark feature encourages the guns use in the dark yet, due to its glow in the dark nature, it safely locates the gun so that it is not accidently fired close to the face or is not left in an unsafe area such as where a baby might accidently fire it. Finally, in preferred embodiments, the chamber is translucent and the main housing of the cap gun is transparent and, upon firing in the dark, the glow in the dark chamber creates one effect, the flash within a chamber creates a second effect, and the back-lighting of the flash through the clear, transparent housing brilliantly lights up the cap gun to create a magnificent yet safe firing effect not achieved by the prior art.

SUMMARY OF THE INVENTION

The present invention is a toy cap gun, which includes a gun housing having a forward end and a rearward end, a chamber, a barrel, a cap anvil, a hammer and a trigger. The chamber is formed of material which permits light from a cap firing flash to be visible therethrough, and the chamber further contains an effective amount of a glow in the dark material. Further, the chamber is movably located within the housing and the chamber and housing together are adapted to load and unload caps. The barrel is located at a forward end of the housing and the chamber. There is a rotatable cap anvil which is located on a rearward end of the chamber, extending into the chamber and adapted to hold caps. The hammer is located on the housing, is connected to a trigger mechanism and is located adjacent to the cap anvil for intermittently striking and detonating caps. There is a trigger mechanism extending from the housing and functionally connected to the hammer for intermittently impacting the hammer to detonate caps.

BRIEF DESCRIPTION OF THE DRAWINGS

The present invention is more fully understood when the specification herein is taken in conjunction with the drawings.

DETAILED DESCRIPTION OF THE INVENTION

Figure 1:
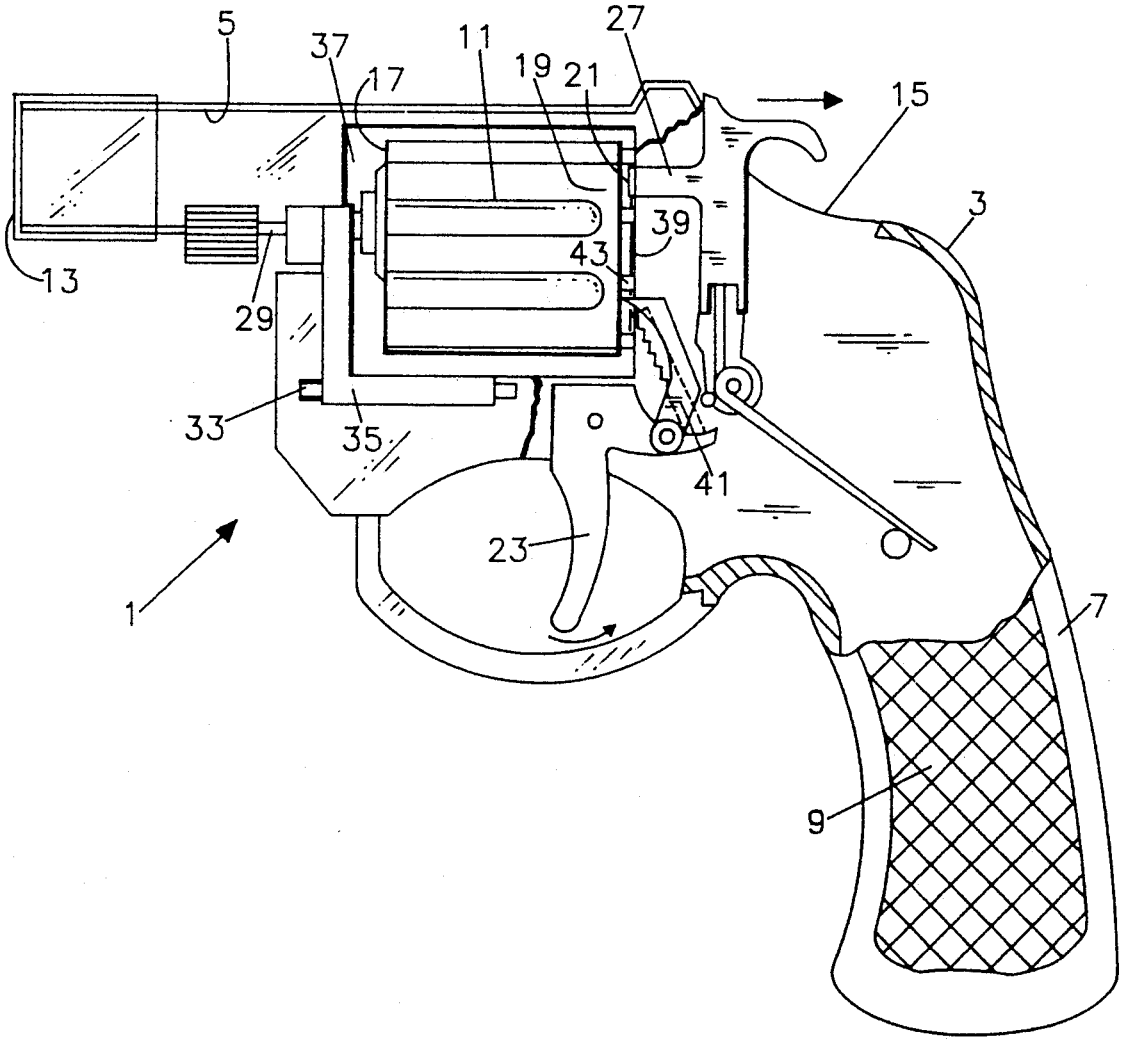
FIG. 1 shows a side cut view of a preferred embodiment toy cap gun of the present invention.

The present invention toy cap gun has the features of known cap guns but further includes a chamber which is formed of a glow in the dark material and is at least partially transparent, translucent or transparent. It is generally constructed of plastic but includes the necessary metal parts such as the hammer and anvil and, in some embodiments, metal springs.

In a preferred embodiment, the present invention toy cap gun has a housing which is transparent. This creates a synergistic effect in that, when the present invention toy cap gun is fired in the dark, the flash back-lighting causes the handle and working parts to be dramatically illuminated.

In another preferred embodiment of the present invention, the chamber is translucent, as well as made of glow in the dark material, and the main housing of the toy cap gun is transparent so that there is a three-fold light effect upon firing, namely, the glow in the dark initial illumination of the barrel, the conversion of the glow in the dark coloration to the yellowish-whitish lighting up of the translucent chamber, and, third, the bright "lightening" effect of the detonating cap flash lighting up the transparent housing.

In all embodiments of the present invention, the glow in the dark aspect of the barrel affords substantial advantages to the present invention toy gun. Not only does it enable a user to locate the toy gun in the dark, whether indoors or outdoors, and even in closets or other normally dark places such as basements or attics, but it also acts as an extra safety feature in that it would immediately show a mother that the cap gun had been accidentally or incorrectly placed near a sleeping baby, e.g. in a crib a night. Further, children playing in the dark would instinctively keep the guns away from their own faces and non-users would move away form the guns in the dark and avoid any flash sparks or other problems due to the glow in the dark feature.

The glow in the dark material which is incorporated within the construction of the chamber may be mixed in at the time of formation of the chamber or may be coated or otherwise applied to the chamber after it has been initially formed. In any case, the glow in the dark material may be any of the varieties of glow in the dark materials commercially available or which may become available. These would include any chemiluminescent material and would include fluorescent dyes, phosphorescent dyes, glow in the dark particles, day glow pigments and the like.

The Kirk-Othmer Encyclopedia of Chemical Technology (third addition, volume 6, page 612), indicates that fluorescent pigments or dyes depend upon their ability to absorb light at one wavelength and to remit it in a narrow intense band at a longer wavelength . . . the dyes used include the rhodamines, which emit pink, aminonaphthalimides which are bright greenish-yellow. To obtain the maximum effect, the dyes are dissolve din brittle resins at low concentrations. Color resins are then ground to powders and used as pigments the brightness of such a combination far exceeds that of any pigment alone. It goes on to indicate that fluorescent dyes do not have light fastness and their use in plastics is confined to the lower temperature resins, vinyls, polyethylene, acrylics and the like. Further, at volume 14, pages 546 and 547, it is indicated that there are many types of luminescent materials, some of which require a special source of excitation such as an electric discharge or ultraviolet radiation. Daylight-fluorescent pigments, in contrast, require no artificially general energy. Daylight, or an equivalent white light can excite these unique materials not only to reflect colored lights selectivity but to give off an extra glow of fluorescent light, often with high efficiency and surprising brilliance . . . Daylight-fluorescent pigments which are particles of colorless resins with few exceptions, and contain dye stuffs that not only have color but are capable of intense fluorescents in solution. The resin of construction may be a solvent for the dyes. For example, a thermo-plastic molten resin may be formed containing the dye and, upon cooling to room temperature, the resin mass becomes very brittle it may be pulverized to the proper fineness and added to other materials.

Manufacturers of fluorescent pigments, phosphorescent materials and other chemiluminescent materials offer varieties of products which may be used with most plastics used today for childrens' toys, containers and other consumer items. Typically, about one to two percent of the total weight of the plastic is added as a dry blended material or is first formulated into a color concentration pellet with is blended into colored resin before molding into a finished article. Thus, a chamber for the present invention may be formed which is transparent and substantially clear but contains particles of glow in the dark materials. Alternatively, there may be a sufficient number of particles which contain the glow in the dark material so as to render the chamber formed translucent rather than transparent or only partially transparent. Finally, the material formation of a present invention toy cap gun chamber may initially be translucent rather than transparent and additional glow in the dark material may be added thereto.

Referring now to FIG. 1, there is shown toy cap gun 1 having housing 3 with barrel 5, handle 7, and grip 9. Present invention toy cap gun 1 is shown in a side cut view and chamber 11 is either transparent, partially transparent or translucent. Its translucency should at least be adequate so that the light from the detonation of a cap will be transmitted therethrough, at least sufficiently for an observer to see the chamber "light up. " Housing 3 has a forward end 13 and a rearward end 15 as shown. Chamber 11 likewise has forward end 17 and a rearward end 19. At rearward end 19 is anvil means 21 for receiving a cap disc or a series of caps. Hammer 27 is movably connected to housing 3 and functionally connected to trigger 23 such that when trigger 23 is pulled, hammer 27 is moved back ( is cocked) and then released to strike caps located adjacent to anvil means 21. In this particular embodiment, there is a shaft 29 which is supported by chamber support 31 to allow chamber 11 to rotate therein and, to advance with anvil means 21 just one cap space to position a next, unfired cap for being struck by hammer 27. Thus, when trigger 23 is pulled, pawl 41 will advance anvil means 21 and chamber 11 at firing position and then trigger 23 will be released and fire a new cap. Ratchet 43 maintains the proper alignment of the anvil and the trigger. Release pivot rod 33 and release snap member 35 permit chamber 11 and anvil means 21 to be held i place, to be swung down for cap loading, and to be removed from cutaway area 37 of housing 3, as desired.

Housing 3 of toy cap gun 1 may be made of any material but is desirably made of plastic and is preferably made of clear, transparent plastic. It may be partially transparent or translucent, but significant transparency enhances the lighting up effect during firing at night.

Chamber 11, is, as mentioned, partially transparent, translucent or transparent. In one preferred embodiment, it is translucent. In another preferred embodiment, it is translucent with the housing of the toy cap gun being transparent, to achieve maximum light effects.

The actual loading and unloading of the caps in a present invention toy cap gun will generally be the same as is used with conventional cap guns and need not be described herein in great detail as it is well within the purview of the artisan. Likewise, while cap discs such as disc 39 are used in this embodiment, the caps could be coming form a rolled paper strip, a straight plastic strip, or otherwise, without exceeding the scope of the present invention.

Obviously, numerous modifications and variations of the present invention are possible in light of the above teachings. It is therefore understood that within the scope of the appended claims, the invention may be practiced otherwise than as specifically described herein.

What is claimed is:

1. A toy cap gun, which comprises:

(a) a gun housing having a forward end and a rearward end;

(b) a chamber being formed of material which permits light form a cap firing flash to be visible therethrough, said chamber further containing an effective amount of a glow in the dark material, said chamber being movably located within said housing and said chamber and housing together being adapted to load and unload caps;

(c) a barrel located at a forward end of said housing and at a forward end of said chamber;

(d) a rotatable cap anvil means located on a rearward end of said chamber, extending into said chamber nd adapted to hold caps;

(e) a hammer located on said housing, connected to a trigger mechanism and located adjacent to said cap anvil means for intermittently striking and detonating caps; and, (f) a trigger mechanism extending form said housing and functionally connected to said hammer for intermittently impacting said hammer to detonate caps.

2. The toy cap gun of claim 1, wherein said chamber is at least partially transparent.

3. The toy cap gun of claim 1, wherein said chamber is translucent.

4. The toy cap gun of claim 1, wherein said chamber is transparent.

5. The toy cap gun of claim 1, wherein said glow in the dark material is chemiluminescent material.

6. The toy cap gun of claim 1, wherein said glow in the dark material is phosphorescent material.

7. The toy cap gun of claim 1, wherein said housing is transparent.

8. The toy cap gun of claim 2, wherein said housing is transparent.

9. The toy cap gun of claim 3, wherein said housing is transparent.

10. The toy cap gun of claim 4, where said housing is transparent.

11. The toy cap gun of claim 5, wherein said housing is transparent.

12. The toy cap gun of claim 6, wherein said housing is transparent.

13. The toy cap gun of claim 1, further comprising means for releasably removably attaching said chamber to said housing.

14. The toy cap gun of claim 1, wherein chamber and anvil means are adapted to receive cap discs.

* * * * *